US008714686B2

(12) United States Patent
Tsuchihashi et al.

(10) Patent No.: US 8,714,686 B2
(45) Date of Patent: May 6, 2014

(54) RECORDING APPARATUS

(75) Inventors: Yoshikane Tsuchihashi, Matsumoto (JP); Tetsuji Yatsunami, Okaya (JP); Kohei Ueno, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 139 days.

(21) Appl. No.: 13/406,315

(22) Filed: Feb. 27, 2012

(65) Prior Publication Data

US 2012/0218339 A1 Aug. 30, 2012

(30) Foreign Application Priority Data

Feb. 28, 2011 (JP) ..... 2011-042332

(51) Int. Cl.
*B41J 29/38* (2006.01)
*B41J 2/01* (2006.01)

(52) U.S. Cl.
USPC ..... 347/16; 347/101; 347/104; 347/105

(58) Field of Classification Search
USPC ..... 347/16, 101–105; 271/162, 153
See application file for complete search history.

(56) References Cited

U.S. PATENT DOCUMENTS

| | | | | |
|---|---|---|---|---|
| 2004/0251592 | A1 | 12/2004 | Ruhe et al. | |
| 2010/0322689 | A1 * | 12/2010 | Ohtani et al. | 399/388 |
| 2011/0292148 | A1 | 12/2011 | Shinagawa et al. | |
| 2011/0316224 | A1 | 12/2011 | Shinagawa et al. | |
| 2011/0316227 | A1 | 12/2011 | Shinagawa et al. | |
| 2012/0001381 | A1 | 1/2012 | Shinagawa et al. | |

FOREIGN PATENT DOCUMENTS

| | | |
|---|---|---|
| JP | 2005-008416 | 1/2005 |
| JP | 2011-246274 | 12/2011 |
| JP | 2012-006745 | 1/2012 |
| JP | 2012-006746 | 1/2012 |
| JP | 2012-012145 | 1/2012 |

* cited by examiner

*Primary Examiner* — Jason Uhlenhake
(74) *Attorney, Agent, or Firm* — Workman Nydegger

(57) ABSTRACT

The present invention includes a stopper that regulates movement of the material onto which the recording will be performed, preventing the material from moving from a cassette to a guide surface when loading the cassette in a loading section, and a sensor that detects that the stopper is in the retracted position.

6 Claims, 13 Drawing Sheets

RECORDING APPARATUS

BACKGROUND

1. Technical Field

The present invention relates to a recording apparatus such as an ink jet printer or the like.

2. Related Art

Among conventional recording apparatus, some have a constitution that includes a loading section and a sheet supply roller. A cassette that houses a stack of sheets is removably inserted into the loading section in a direction normal to the stacking direction. The sheet supply roller feeds out sheets one at a time from the cassette in the loading section and transports them sequentially to a recording section. An upward sloping guide plate is provided in this recording apparatus at the inside of the loading section, to separate sheets that have been transported at a time out from the cassette and guide them to the recording section.

When a user loads the cassette into the loading section, if the speed of insertion into the loading section is fast, sometimes stacked sheets are moved by the force of inertia from within the cassette in the insertion direction and climb up onto the guide surface. When this happens, the sheets might not be separated one at a time on the guide surface.

This problem of sheets climbing up onto the guide surface occurs not only in the structure for inserting the cassette, but in the structure of a supply device that inserts sheets alone onto the upward sloping guide surface, and presses the leading edge of the sheets so that they project onto the guide surface.

In JP-A-2005-8416, a mechanism that prevents the sheets from moving too far into the printer when the cassette is loaded is disclosed, as a way to avoid this problem.

However, the conventional way of avoiding this problem had disadvantage in reliability and in mechanism having a regulating member that is movable between a position in which the member protrudes into the movement path to block the sheets and a position in which the member does not protrude into the movement path.

SUMMARY

An advantage of some aspects of the invention is that in a supply device constituted such that, after moving an object or the like in a first direction, the object is moved along the guide surface that extends in a second direction intersecting the first direction, thus, when the object is set on the supply device, the problem of climbing up the guide surface is solved, and also it is possible to reliably determine whether or not a transport mechanism can start to transport the object.

To achieve the above advantages, a recording apparatus according to a first aspect of the invention includes a recording head that records onto recording material; a cassette that houses the recording material; a loading section for loading the cassette; a guide surface that guides the recording material fed from the cassette that is loaded in the loading section; a supply mechanism that feeds the recording material housed in the cassette that is loaded in the loading section; a stopper that regulates movement of the recording material moving onto the guide surface when the cassette is loaded in the loading section, and that is retracted from the guide surface; and a sensor that detects that the stopper has moved into a retracted position.

According to a second aspect of the recording apparatus of the first aspect, the recording apparatus may further include a control unit that controls the feeding operation by the supply mechanism after the sensor has detected that the stopper has moved into the retracted position.

According to a third aspect of a supply device of the second aspect, the supply device may further include a screen that is coupled to movement of the stopper, and the sensor may be an optical sensor that detects the screen blocking a light path.

According to a fourth aspect of the supply device of the third aspect, the screen may be located in a position separated from the stopper.

According to a fifth aspect of the supply device of the fourth aspect, the supply device may further include a damper mechanism that applies a braking force to the movement of the stopper into the retracted position.

According to a sixth aspect of the supply device of the fifth aspect, the stopper may include a slider having a sliding surface that constitutes the damper mechanism, and the screen may be provided on the slider.

Also, the supply device according to a seventh aspect of the invention includes a stopper, a supply mechanism, a stopper moving mechanism, a damper mechanism, and a sensor. The stopper can regulate the movement of an object after the object has moved in a first direction, by contacting the object that moves on a guide surface extending in a second direction which intersects with the first direction. The supply mechanism is located in a housing portion in front of the guide surface in the first direction, and feeds the object in the first direction. The stopper moving mechanism moves the stopper to a regulating position that regulates the movement of the object, and a retracted position. The regulating position is located to the front of the guide surface. The stopper is retracted from the regulating position and enables the object to move. The stopper moving mechanism is constituted so that the movement of the stopper from the regulating position to the retracted position starts as a result of a setting operation of housing objects in the housing portion along the first direction. The damper mechanism applies a braking force to at least the movement from the regulating position to the retracted position from among the movements of the stopper. The sensor detects when the stopper has moved into the retracted position.

Here, "setting operation of housing the objects in the housing portion along the first direction" is used to mean both an operation of loading a cassette that houses a plurality of the objects in a stacked state into the loading section that has a structure that enables the cassette to be loaded and removed, and an operation of setting the objects in the loading section which has a structure in which the objects alone are inserted towards the upward sloping guide surface and housed, without using a structure for inserting a cassette.

According to this aspect, the stopper is constituted such that it starts to move from the regulating position to the retracted position as a result of the setting operation of housing the objects in the loading section. In addition, the stopper starts to move gently under the effect of the braking force of the damper mechanism, and continues to move gently to the retracted position. By starting this gentle movement, the movement of the object in the first direction based on the setting operation of inserting the cassette or the like is stopped by the stopper, thus it is possible to reduce the occurrence of the climbing up problem.

Thereafter, the stopper continues to move gently and arrives at the retracted position, and the arrival is detected by the sensor. Therefore, it is possible to ensure that transport of the object is not started by the supply mechanism before the stopper arrives at the retracted position.

Also, if the braking force of the damper mechanism varies due to variations in the ambient environment such as temperature, the time required to arrive at the retracted position will vary. However, according to this aspect the sensor detects the arrival at the retracted position without being affected by these variations, thus, it is possible to start the subsequent operation at the appropriate timing.

In the seventh aspect, the stopper may be constituted to be rotatably supported at a base end, and move from the regulating position to the retracted position by rotation.

By constituting the stopper in this way, the stopper uses a space as small as the space needed for the rotation operation, thus, it is possible to reduce the size of the supply device or the recording apparatus.

According to an eighth aspect of the supply device of the seventh aspect, the supply device may further include a control unit that controls the feeding operation by the supply mechanism under the condition that the sensor is ON.

According to this aspect, it is possible to prevent the start of transport of the object by the supply mechanism before the stopper arrives at the retracted position under the control by the control unit.

According to a ninth aspect of the supply device of the seventh aspect or the eighth aspect, the sensor may be an optical sensor that detects a screen blocking a light path, the screen is constituted so that its movement is coupled with the movement of the stopper, and the light path and the screen of the optical sensor are disposed in positions at a distance from the stopper.

According to this aspect, the light path and the screen of the optical sensor are disposed in positions at a distance from the stopper, thus, it is possible to lower the possibility that the optical sensor will be covered by paper dust generated at an area near the stopper.

According to a tenth aspect of the supply device of the ninth aspect, an aperture for emitting the light may be provided at the rear of a member on which an object is transported.

According to this aspect, it is possible to further lower the possibility that the optical sensor will be covered by paper dust generated at the stopper area.

According to an eleventh aspect of the recording apparatus of any one of the seventh aspect through the tenth aspect, the recording apparatus may include a recording execution unit that carries out the recording on the objects, and the supply device that transports the objects to the recording execution unit.

According to this aspect, it is possible to obtain the effect of the supply device according to any one of the seventh aspect through tenth aspect in a recording apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
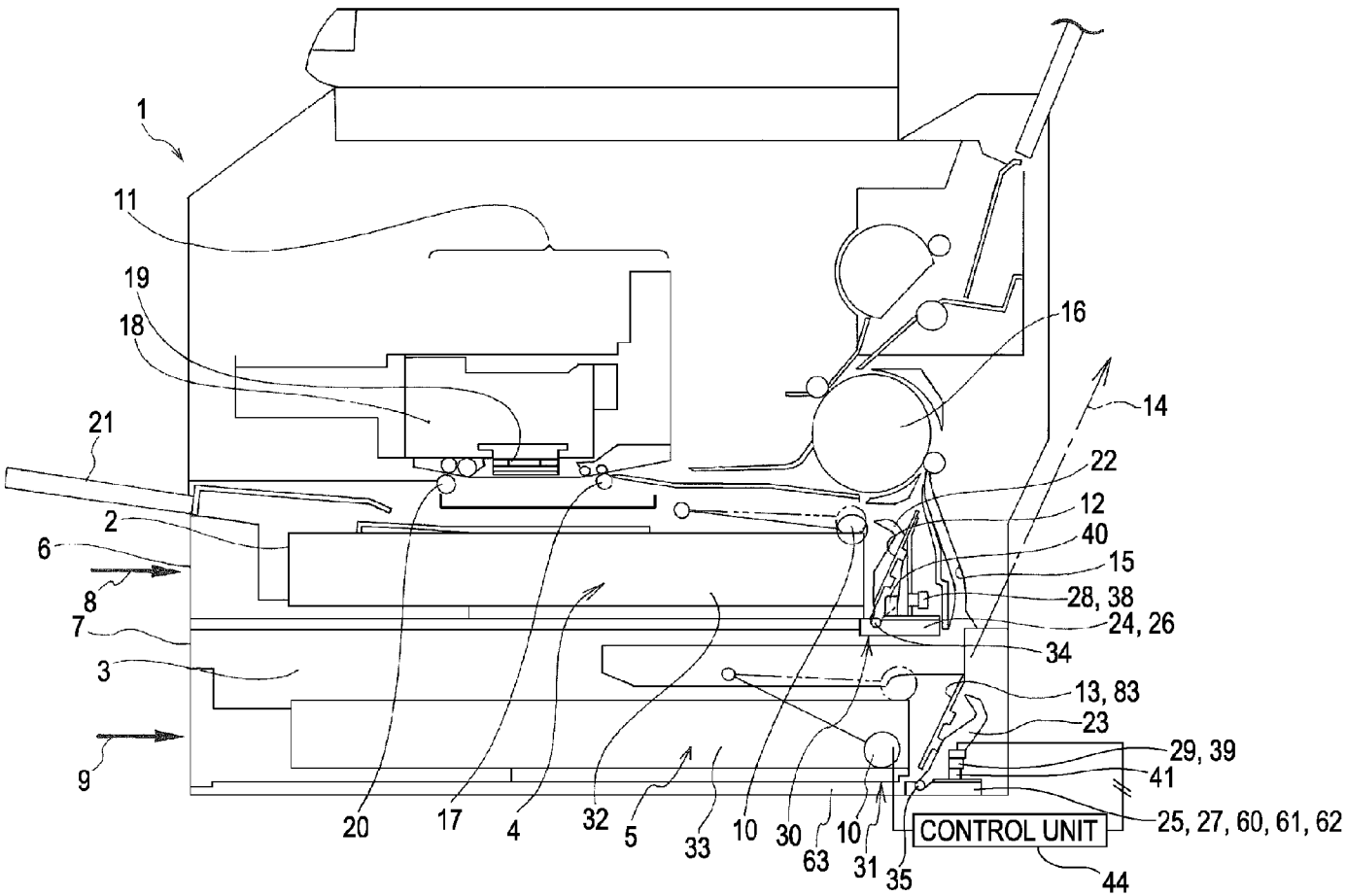
FIG. 1 is a side cross-sectional view showing the schematic internal structure of a recording apparatus having a supply device according to a first embodiment of the invention.
Figure 2:
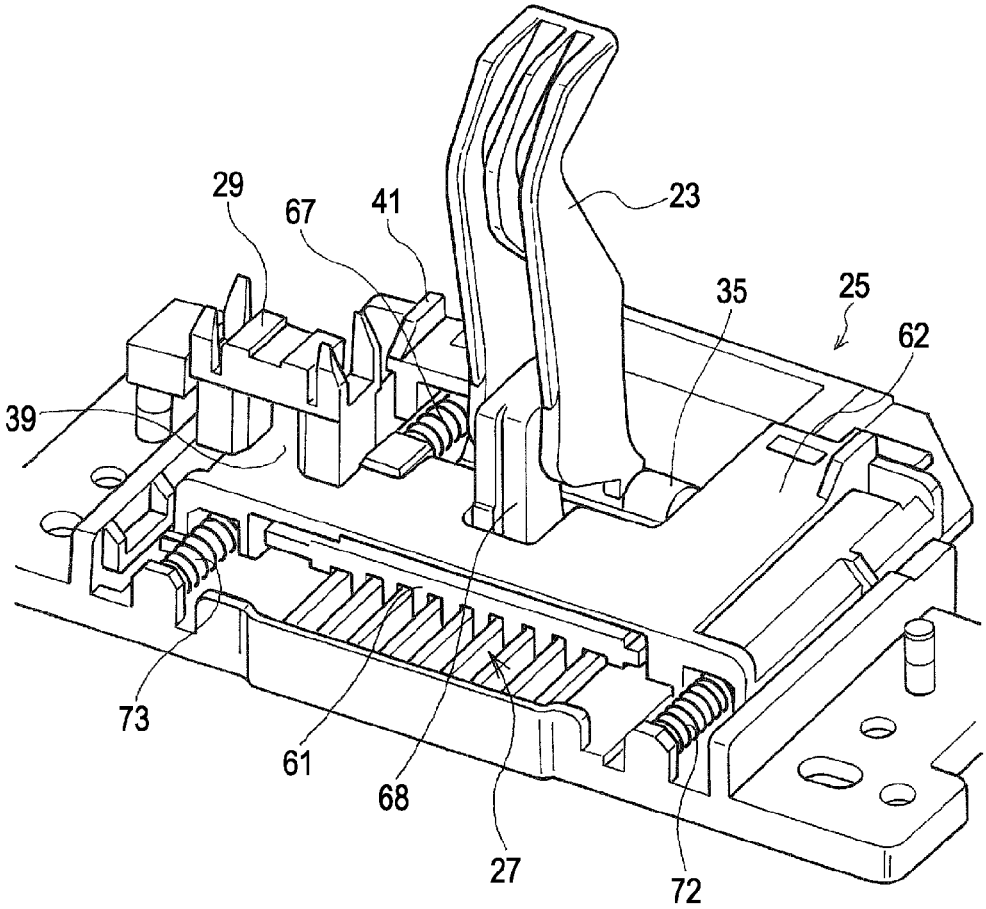
FIG. 2 is a perspective view of a stopper movement mechanism of the supply device according to the first embodiment.

The basic constitution of a recording apparatus 1 according to a first embodiment of the invention is described with reference to FIG. 1. As shown in FIG. 1, the recording apparatus 1 is an ink jet printer 1 (using the same reference numeral as "recording apparatus") with a structure in which two cassettes are loaded at upper and lower loading sections.

The ink jet printer 1 has an upper loading section 2 and a lower loading section 3, into which an upper cassette 4 and a lower cassette 5 are inserted and loaded from their respective entrances 6, 7 in a first direction which is along arrow symbols 8, 9. The objects which are materials on which the recording will be performed (hereinafter also referred to as "sheets") can be contained in each of the cassettes 4, 5.

Upward sloping guide surfaces 12, 13 are provided at the innermost section of each of the loading sections 2, 3 into which the cassettes 4, 5 are loaded. The sheets transported from the cassette by a sheet supply roller 10, which forms a supply and feeding mechanism, are separated one by one at the guide surfaces 12, 13, and fed to a recording execution area 11. Here, the direction formed by the upward slope of the guide surfaces 12, 13 corresponds to a second direction (arrow symbol 14) in the invention.

The sheets that are separated at the guide surfaces 12, 13 are led to a transport roller 17 located on the upstream side of the recording execution area 11 via a transport path 15, a rotating drum 16, and so on (transported to the left in the plane of the paper in FIG. 1). Then, the recording is executed by ejecting ink from a recording head 19 mounted on a carriage 18 that moves back and forth in a direction normal to the plane of the paper in FIG. 1.

The sheets on which recording has been executed by the recording head 19 are discharged by a discharge roller 20 onto a sheet receiving section 21.

Stoppers 22, 23, stopper moving mechanisms 24, 25, damper mechanisms 26, 27, and sensors 28, 29 are provided at the positions where the guide surfaces 12, 13 are provided. Details of these are described in turn later.

In other words, supply devices 30, 31 of this embodiment include the stoppers 22, 23, the sheet supply rollers 10, and the stopper moving mechanisms 24, 25. The stoppers 22, 23 can regulate the movement of the sheets by contacting the sheets that move on the guide surfaces 12, 13 that extend in the second direction (arrow symbol 14), which intersects with the first direction, after moving on the first direction (arrow symbols 8, 9). The sheet supply rollers 10 are located in housing portions 32, 33 in front of the guide surfaces 12, 13 in the first direction, and feed the sheets in the first direction. The stopper moving mechanisms 24, 25 move the stoppers 22, 23 to a regulating position, which regulates the movement of the sheets, and to a retracted position. The regulating position is located in front of the guide surfaces 12, 13 (the position of the stopper 22 on the upper guide surface 12 in FIG. 1). The stopper is retracted from the regulating position and enables the sheets to move (the position of the stopper 23 behind the guide surface 13 in the lower stage shown in FIG. 1).

The stopper moving mechanisms 24, 25 are constituted so that the movement of the stoppers 22, 23 from the regulating position to the retracted position starts as a result of the setting operation of loading the cassettes 4, 5 in the loading sections 2, 3, in other words the setting operation of housing the sheets in the housing portions 32, 33 along the first direction.

The supply devices 30, 31 of this embodiment also include the damper mechanisms 26, 27 that apply a braking force to at least the movement from the regulating position to the retracted position from among the movements of the stoppers 22, 23, and sensors 28, 29 that detect when the stoppers 22, 23 have moved into the retracted position.

Stopper Moving Mechanism (FIG. 2, FIGS. 7 through 12)

Next, the structure of the stopper moving mechanisms 24, 25 is described in further detail with reference to FIG. 2 and FIGS. 7 through 12. The stopper moving mechanism 24 and the stopper moving mechanism 25 have basically the same structure, thus, in the following one stopper moving mechanism 25 is described as representative, and the description of the other stopper moving mechanism 24 is omitted.

The stopper moving mechanism 25 includes a base 60, a slider 61, a slider cassette 62, and the stopper 23 which regulates the movement of sheets P. In the drawings used for the following description, including FIG. 7, for ease of description, the direction of removal of the cassette 5 is referred to as D1, the insertion direction is D2, and of the directions normal to these directions, the direction of the thickness of the sheets P (in other words the vertical direction) is D3, and the width direction of the sheets P is D4.

The base 60 is fixed to a frame 63 of the ink jet printer 1 (FIG. 1). Also, a first sliding surface 64 on which the slider 61 slides is provided in the center of the base 60 in the width direction D4 of the sheets P. In this embodiment, the sliding directions of the slider 61 are the cassette 5 insertion direction D2 and the removal direction D1.

Figure 8:
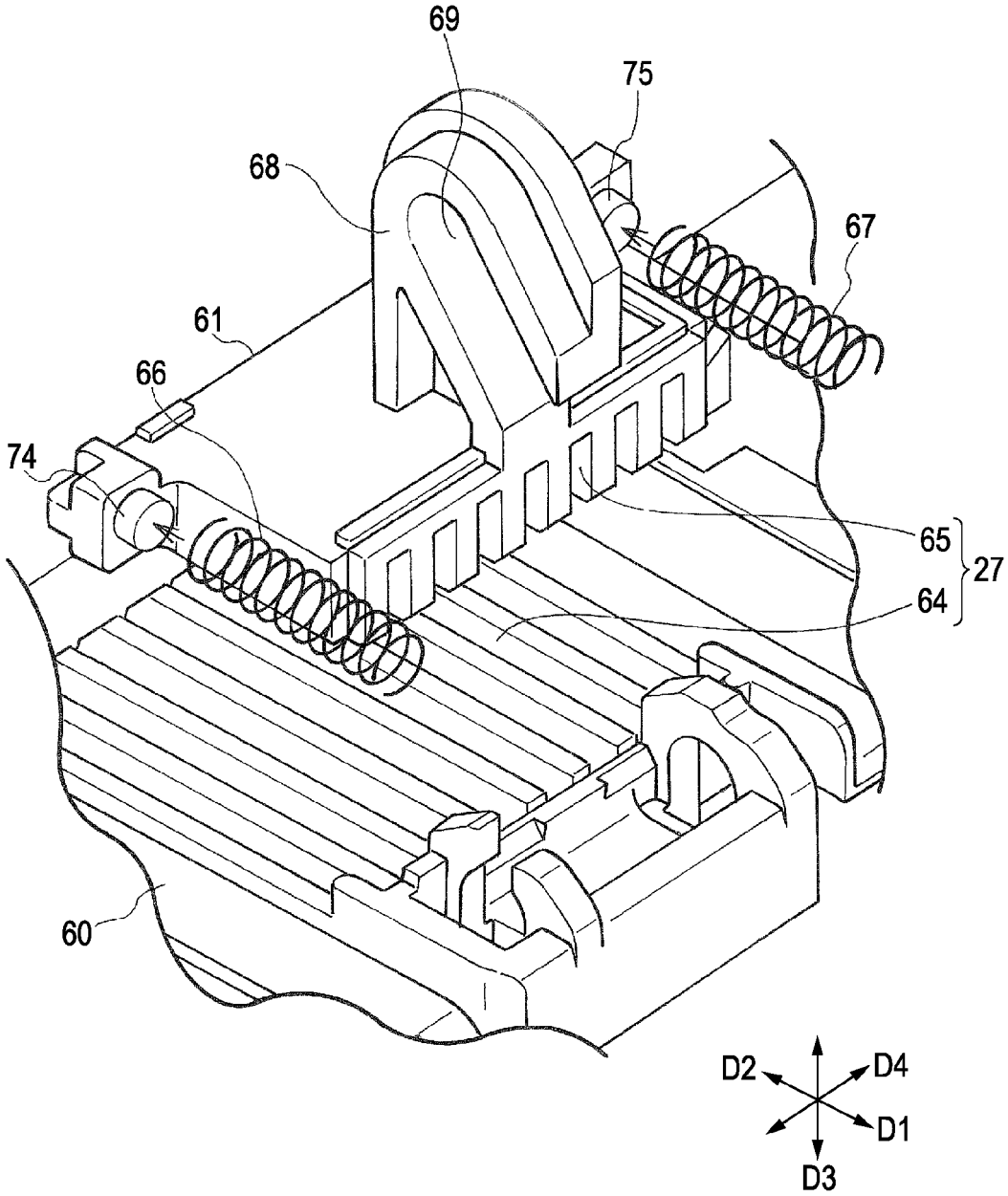
FIG. 8 is an exploded perspective view showing the constitution of the stopper of the first embodiment.

The damper mechanism 27 that is constituted by the first sliding surface 64 and the slider 61 is next described using FIG. 8. FIG. 8 is a perspective view showing the state with the slider cassette 62 and the stopper 23 removed and the slider 61 separated from the base 60.

Damper Mechanism (FIG. 8)

As shown in FIG. 8, a second sliding surface 65 is provided on the slider 61 in opposition to the first sliding surface 64. The second sliding surface 65 has a so-called comblike structure that is formed by grooves and lands such that the grooves and lands extend in the direction of sliding (the insertion direction D1 or the removal direction D2). In other words, the grooves and lands form a repeated structure in the width direction D4 that is normal to the sliding direction. The grooves and lands, which are parallel each other, make the second sliding surface 65 approximately rectangular in the plan view seen along the thickness direction D3, that is, overlapping direction with the first sliding surface 64.

On the other hand, the first sliding surface 64 is provided on the base 60 and has plane areas that are longer in the insertion direction D1 than those of the second sliding surface 65 provided on the slider 61. Therefore, the slider 61 can move a predetermined distance in the cassette removal direction D1 and insertion direction D2. The first sliding surface 64 is formed in an irregular shape in opposition to the irregular shape formed on the second sliding surface 65, having predetermined spacing, and with a grease disposed therebetween as a viscous material.

The slider 61 can move on the first sliding surface 64 of the base 60, with grease disposed between the second sliding surface 65 and the first sliding surface 64, and with the slider 61 impelled in the insertion direction D2 by a pair of coil springs 66, 67 as impelling members. In this case, the damper mechanism 27 which generates a braking force in the direction of sliding is constituted by the first sliding surface 64 and the second sliding surface 65 with the grease disposed therebetween.

Stopper Moving Mechanism (FIGS. 7 through 12)

In the following, the stopper moving mechanism 25 is again described.

As shown in FIG. 8, a projection 68 having a hook shape is formed on the surface of the slider 61 on the opposite side to the side on which the second sliding surface 65 is provided. The projection 68 has a slit serving as an engaging space 69 that penetrates the projection 68 in the width direction D4. The engaging space 69 is slanted downward towards the removal side D1 and has an open end.

Figure 7:
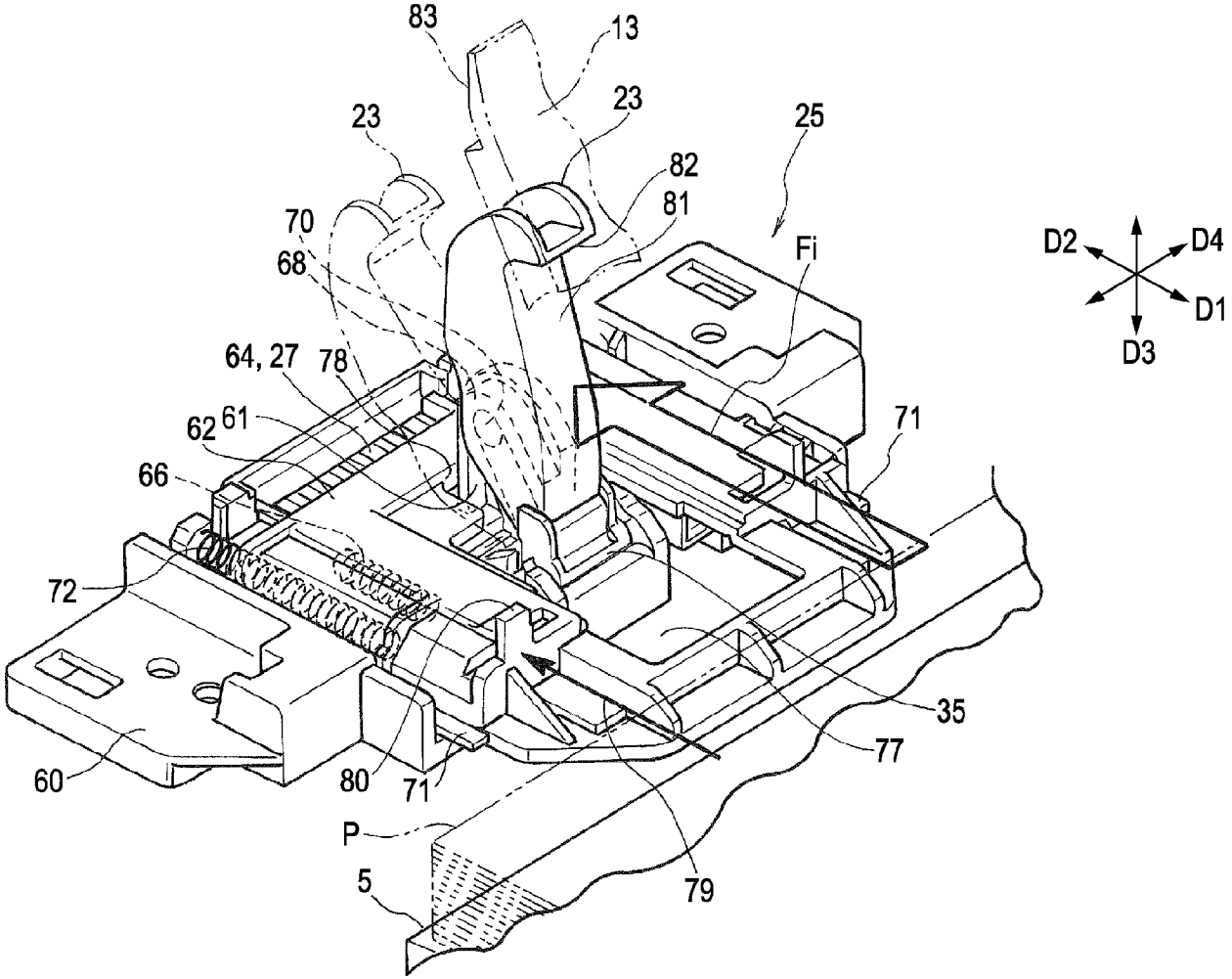
FIG. 7 is a perspective view showing the constitution of the stopper moving mechanism in the first embodiment.

As shown in FIG. 7, this engaging space 69 engages with an engaging pin 70 of the stopper 23 which is described later.

As shown in FIG. 7, the slider cassette 62 engages with the base 60 at edges 71 on both sides in the width direction D4. In addition the slider cassette 62 can move forward and backward (slide) along the insertion direction D1 and the removal direction D2 while maintaining this engaged state. Also, the slider cassette 62 is constantly impelled in the removal direction D1 by a pair of coil springs 72, 73 (see FIG. 9 and FIG. 10).

The coil springs 72, 73 are compression springs disposed so that they are maintained or fixed with one end on the base 60, and the other end on the slider cassette 62. Also, the coil springs 72, 73 are disposed in positions that are further from the center of the second sliding surface 65 in the width direction D4 of the sheets P than the coil springs 66, 67 that impel the slider 61 in the insertion direction D2. Specifically, in plan view in the thickness direction D3, the coil springs 72, 73 are disposed in positions that do not overlap in plan with the coil springs 66, 67, in positions near the two edges in the width direction D4 on the opposite side of the coil springs 66, 67 to the center of the second sliding surface 65.

One end of the coil springs 66, 67 is fixed to spring supports 74, 75 on the slider 61, and the other end is supported or fixed to spring supports (only one spring support 76 is shown on FIG. 11 and FIG. 12) provided on the slider cassette 62 in opposition to the spring supports 74, 75.

Also, an aperture 77 is provided in the slider cassette 62 in the center portion in plan view in the thickness direction D3. The projection 68 of the slider 61 is located within this aperture 77. An aperture edge 78 on the insertion direction D2 of the aperture 77 is formed so that when the slider 61 moves in the insertion direction D1, the aperture edge 78 contacts a part of the projection 68 of the slider 61. Therefore, the slider cassette 62 regulates the movement of the slider 61 in the insertion direction D2 by the aperture edge 78 of the aperture 77.

On the other hand, a contact portion 80 is formed on the slider cassette 62 that is contacted by the edge of the cassette 5 that is inserted in the printer 1 in the insertion direction D2 when the cassette 5 moves in the direction of the bold-line arrow symbol 79 in FIG. 7. In this embodiment, in the slider cassette 62, the other ends of the coil springs 72, 73 and the coil springs 66, 67 are supported or fixed to a surface in almost the same location as the contact portion 80, on the opposite side to the surface that contacts the cassette 5.

As shown in FIG. 7, a first regulating surface 81 and a second regulating surface 82, which are approximately flat surfaces, are provided on the stopper 23 on the removal direction D1 side in opposition to the sheets P. In this way, the first regulating surface 81 and the second regulating surface 82 are formed on the same member. Also, in the state prior to loading the cassette 5, the first regulating surface 81 is provided in a direction that intersects with the guide surface 13 of a guide plate 83, in a direction that is slightly inclined to the guide surface 13 away from the thickness direction D3, which is normal to the insertion direction D2. The second regulating surface 82 is provided normal to the first regulating surface 81.

Also, a rotation shaft 35 is formed in an end of the stopper 23 on the thickness direction D3 side (in this case, the bottom end), and the stopper 23 is installed on the base 60 so that the stopper 23 can rotate with the rotation shaft 35 as support point. Therefore, the first regulating surface 81 and the second regulating surface 82 provided on the stopper 23 also move in rotation with the rotation shaft 35 as the support point according to the rotation of the stopper 23.

In addition, a pair of walls is formed in the stopper 23 from the two side ends in the width direction D4 extending parallel towards the opposite side of the first regulating surface 81. A cylindrical shaped engaging pin 70 whose axial direction extends in the width direction D4 is supported between the pair of walls. The engaging pin 70 engages with the engaging space 69 provided on the projection 68 of the slider 61 as described previously, constituting a so-called cam mechanism. As a result of this cam mechanism, the stopper 23 rotates about the rotation shaft 35 on the base end side thereof as the slider 61 moves in the insertion direction D2, and the tip end of the stopper 23 inclines towards the insertion direction D2. As a result of this inclination, the stopper 23 moves from the regulating position that regulates the movement of the sheets P prior to loading the cassette 5 and tilts as a whole towards the insertion direction D2 as indicated by the chain double-dashed line in the drawings and is retracted into the retracted position on the insertion direction D2 side of the guide surface 13.

This action is described in FIGS. 9 through 12.

Figure 9:
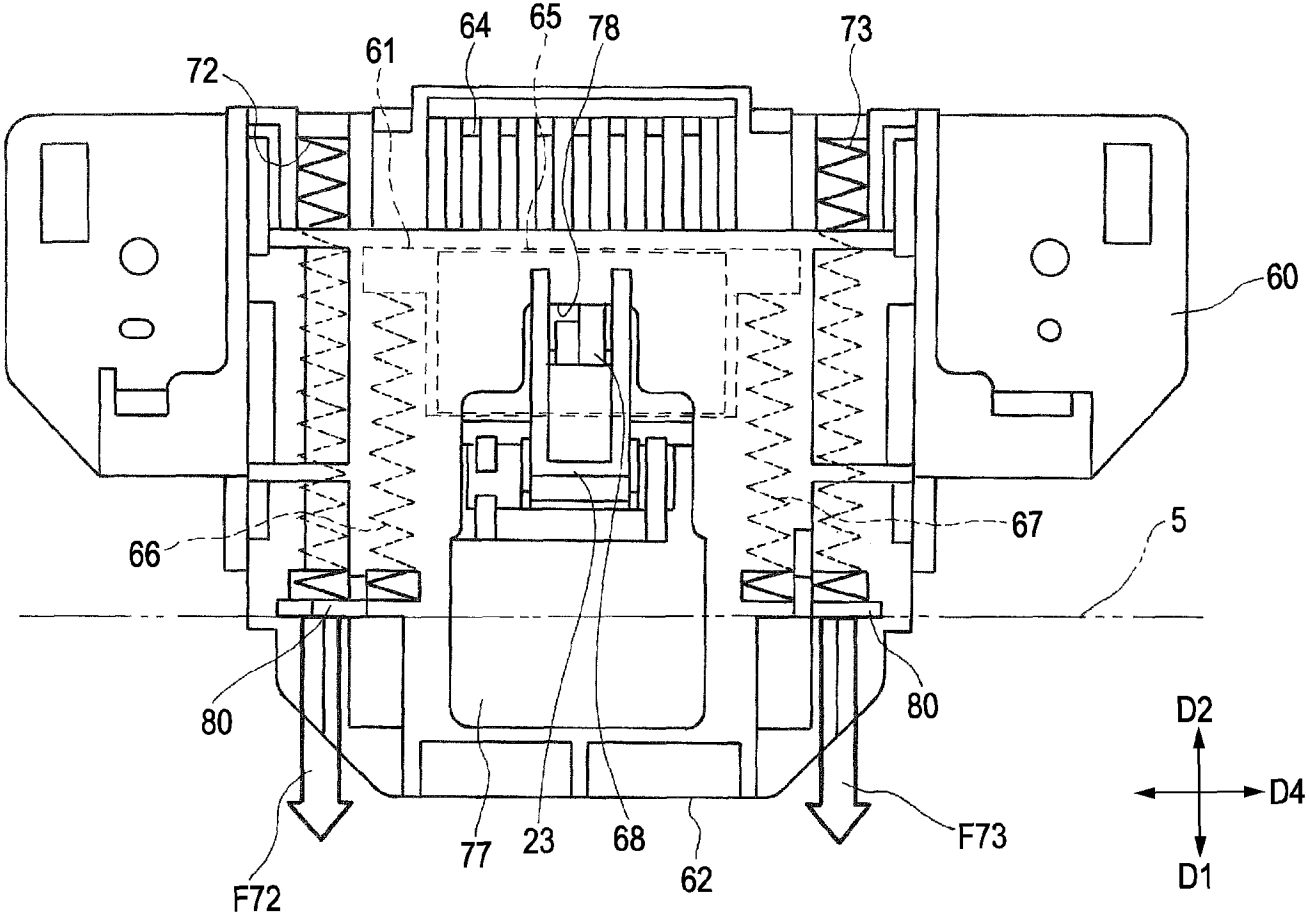
FIG. 9 is a plan view of the stopper moving mechanism with the stopper in the regulating position prior to loading the cassette in the first embodiment.

As shown in FIG. 9, when the cassette 5 is not yet in the loaded state where it contacts the contact portion 80 of the slider cassette 62, the slider cassette 62 is impelled in the removal direction D1 by the spring force F72, F73 of the coil springs 72, 73. Therefore, the aperture edge 78 of the aperture 77 of the slider cassette 62 presses the projection 68 of the slider 61 in the removal direction D1, so the slider 61 does not move in the insertion direction D2. Also, at this time the slider 61 contacts a contact portion (not shown on the drawings) provided on the base 60, the slider 61 also does not move in the removal direction D1 side, thus, its position is determined.

In this way, the position of the slider 61 is determined by the aperture edge 78 of the slider cassette 62 and the contact portion of the base 60, so the stopper 23 is maintained in the regulating position (the position indicated by the solid lines in FIG. 7) that regulates the movement of the sheets P. In the regulating position, the second sliding surface 65 of the slider 61 is positioned on the removal direction D1 side of the plane area of the first sliding surface 64.

Figure 10:
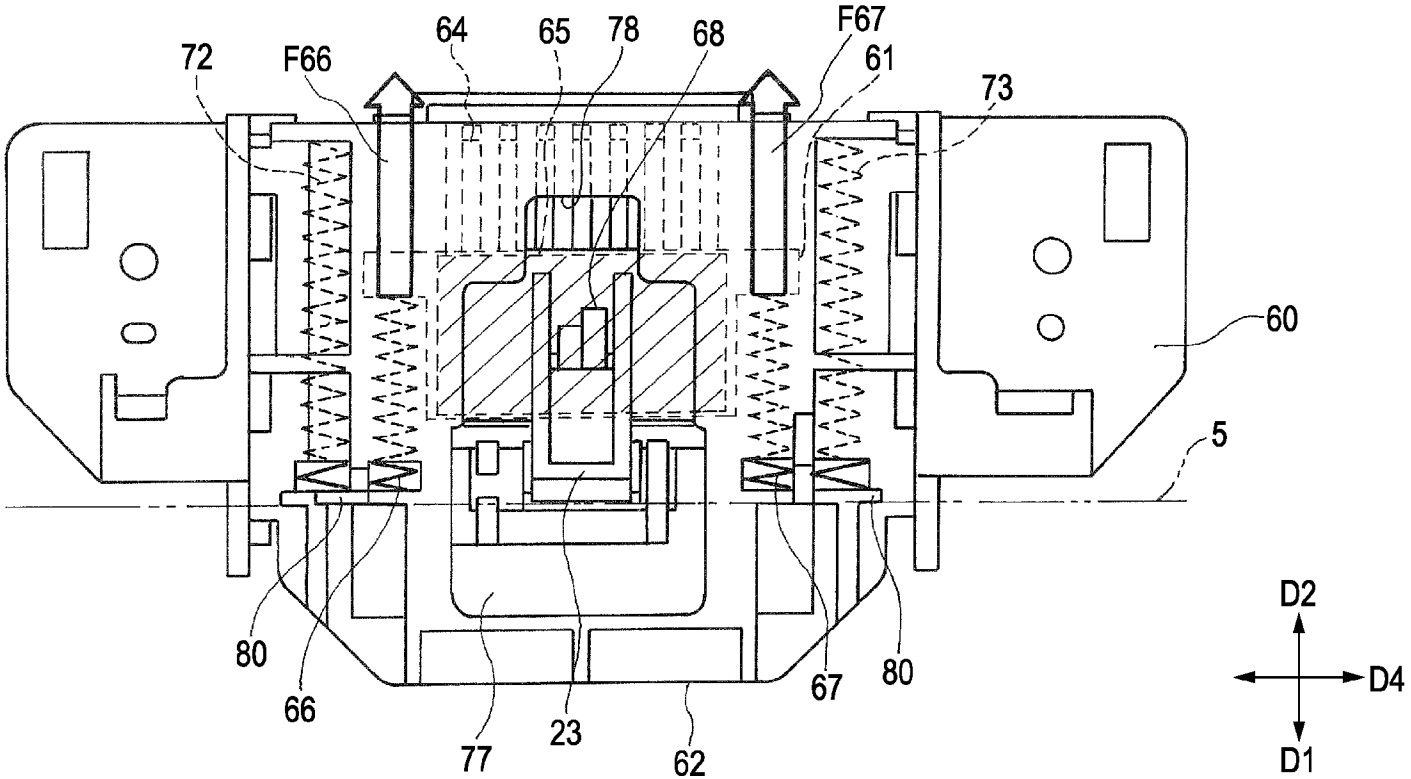
FIG. 10 is a plan view of the stopper moving mechanism with the stopper not yet in the regulating position after loading the cassette in the first embodiment.
Figure 11:
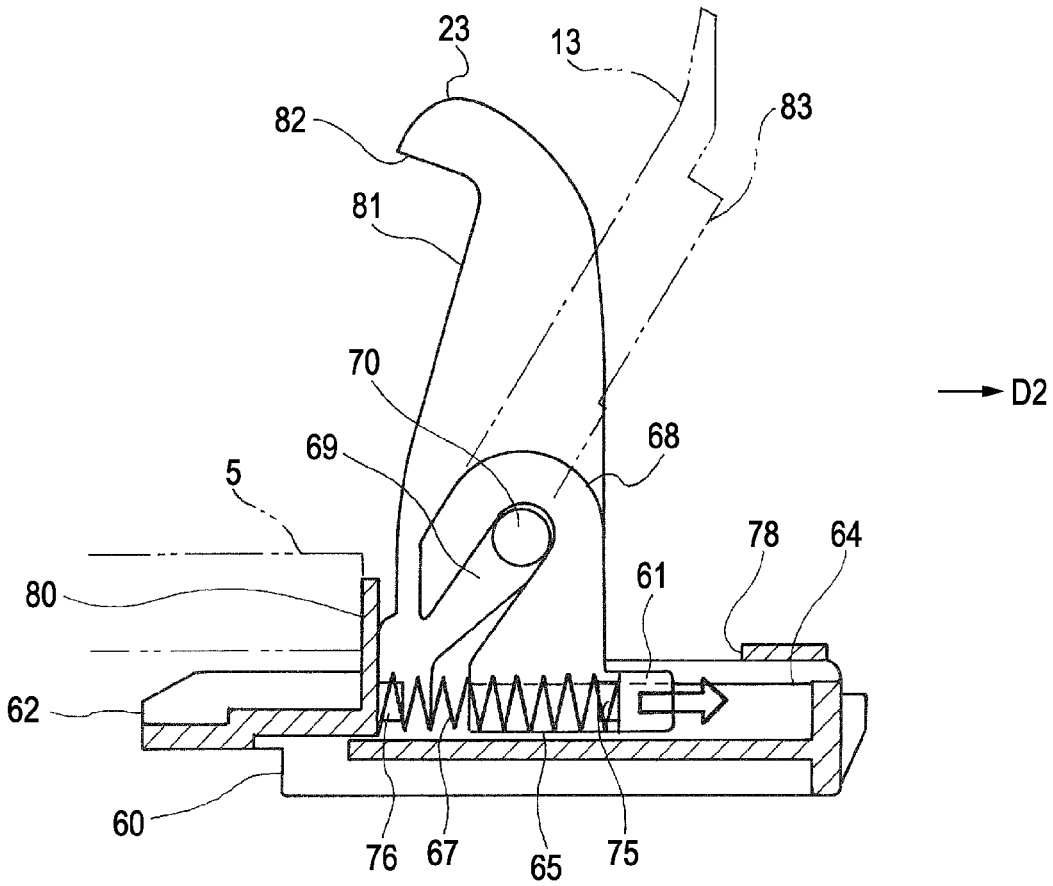
FIG. 11 is a side cross-sectional view of the principal parts shown in FIG. 10.

Next, as shown in FIGS. 10 and 11, when the cassette 5 is inserted, the slider cassette 62 is pressed to move in the insertion direction D2 by the loading of the cassette 5 which contacts the contact portion 80. Therefore, the aperture edge 78 of the slider cassette 62 is separated from the slider 61, thus, the slider 61 is able to move in the insertion direction D2. At this time, as stated previously, as a result of the action of the damper mechanism 27 which is formed between the first sliding surface 64 and the opposing second sliding surface 65 with the grease disposed therebetween, the slider 61 does not move immediately, and the coil springs 66, 67 are compressed.

The compressed coil springs 66, 67 generate spring forces F66, F67 along the insertion direction D2 as indicated by the outline arrow symbols in the drawing. Therefore, as a result of the generation of the spring forces F66, F67, the slider 61 moves (slides) on the first sliding surface 64 along the insertion direction D2 with the second sliding surface 65 (the portion hatched in FIG. 11) in opposition to the first sliding surface 64. As a result of the action of the braking force of the damper mechanism 27 on this movement, the slider 61 moves gently in the insertion direction D2 with a speed corresponding to the difference in the spring forces F66, F67 and the braking force. Therefore, in the stopper moving mechanism 25, the stopper 23 which is linked to the slider 61 via the cam mechanism slowly rotates and moves from the regulating position to the retracted position under the action of the braking force exhibited by the damper mechanism 27.

Figure 12:
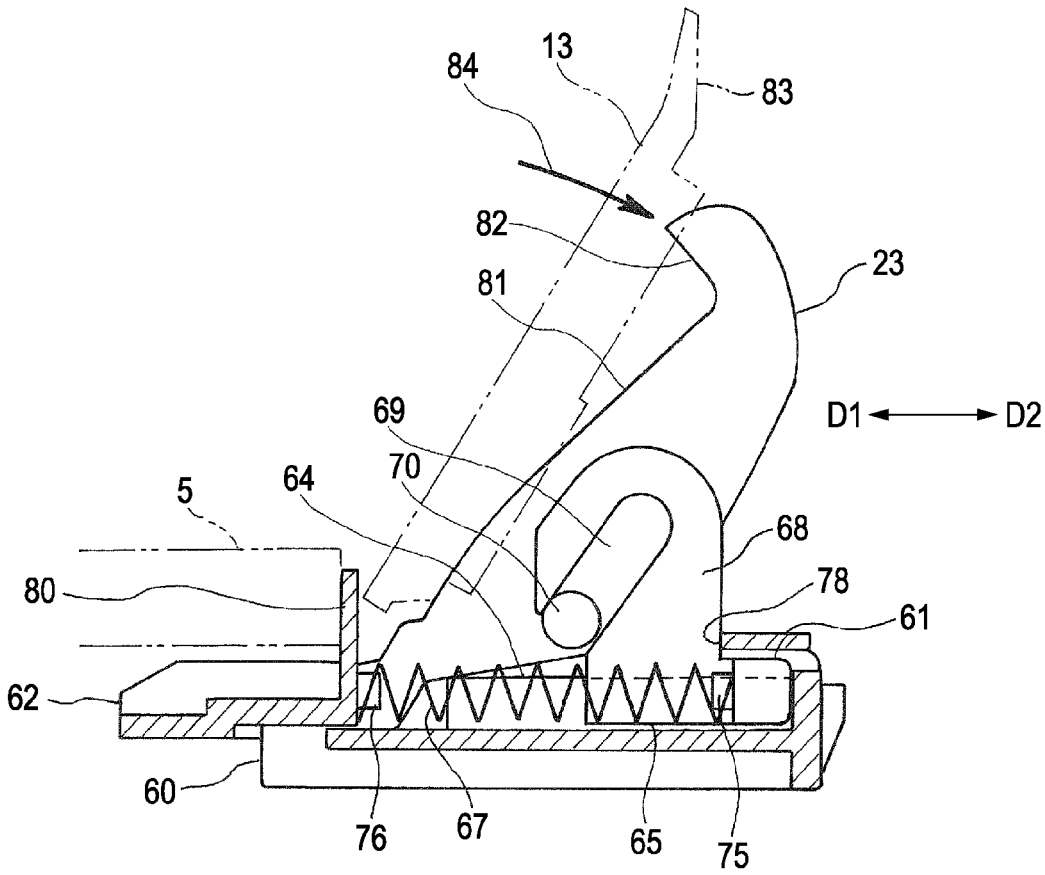
FIG. 12 is a principal side cross-sectional view with the stopper in the first embodiment in the retracted attitude.

Next, the rotational action of the stopper 23 moving from the regulating position to the retracted position after loading the cassette 5 is described with reference to FIG. 11 and FIG. 12. In FIGS. 11 and 12, for ease of description, some of the constituent members are shown in cross-section where necessary.

First, as shown in FIG. 11, after loading the cassette 5, the slider 61 does not immediately move in the insertion direction D2 due to the braking force of the damper mechanism 27, but is positioned for a while in the regulating position. Then, the slider 61 gently moves in the insertion direction D2 as a result of the spring forces F66, F67 of the coil springs 66, 67 and the braking force of the damper mechanism 27 that acts to resist the spring forces F66, F67. At this time, as a result of the action of the cam mechanism of the engaging space 69 of the projection 68 of the slider 61 and the engaging pin 70, the tip of the stopper 23 gently reclines towards the insertion direction D1 side.

Here, the role of the second regulating surface 82 is described.

If the sheets P that have contacted the first regulating surface 81 and stopped moving still have kinetic energy, the leading edges of the sheets will attempt to move onto (clime up onto) the first regulating surface 81 of the stopper 23 which is gradually reclining. When the sheets are stopped by the second regulating surface 82 this movement (climbing up) is stopped, and it is possible to prevent the climbing up.

Then, as shown in FIG. 12, when the slider 61 has moved a predetermined distance in the insertion direction D2, the end thereof on the insertion direction D2 side contacts the contact portion (not shown in the drawings) provided on the base 60, so the position of the slider 61 is determined. When the slider 61 is in the determined position, the stopper 23 rotates as indicated by the arrow symbol 84 in FIG. 12, and arrives at the retracted position where the stopper 23 is retracted to the insertion direction D2 side of the guide surface 13 of the guide plate 83. In other words, in the retracted position, the first regulating surface 81 and the second regulating surface 82 are retracted to the insertion direction D2 side of the guide surface 13 of the guide plate 83.

When the cassette 5 is removed from the loading section 3, the slider cassette 62 is pressed to move in the removal direction D1 by the impelling force of the coil springs 72, 73, and the slider 61 returns to its initial position before the cassette 5 was loaded. Then, as the slider 61 returns to its initial position, the stopper 23 is rotated by the cam mechanism, and returns to its initial attitude from the reclined attitude, in other words returns from the retracted position to the regulating position.

In the stopper moving mechanism 25 that is constituted in this way, when the stopper 23 is moving (rotating) from the regulating position to the retracted position, the sheets P that have moved to the insertion direction D2 side associated with the insertion of the cassette 5 contact the stopper 23 and are stopped. As a result of this contact, it is possible to stop the sheets P from climbing up the guide plate 83 with high probability. In other words, the stopper 23 receives the inertia force Fi (see the bold outline arrow symbol in FIG. 7) produced when the moving sheets P are decelerated, and the movement of the sheets P is regulated. In this way, the movement speed of the sheets P is weakened, and ultimately the kinetic energy of the sheets P will be dissipated, and the sheets P will be stopped with high probability.

Sensor (FIG. 1, FIGS. 2 through 5)

A sensor 29 detects that the stopper 23 has moved to the retracted position.

As shown in FIGS. 2 through 5, the sensor according to this embodiment is an optical sensor that detects whether a light path 39 (reference numeral 38 in the upper stage of the loading section 2) is blocked by a screen 41 (reference numeral 40 in the upper stage of the loading section 2). The screen 41 is mounted on the slider 61 so that the movement of the screen 41 is coupled with the movement (rotation) of the stopper 23. Then the light path 39 and the screen 41 of the optical sensor 29 do not have to be directly provided on the stopper 23, but can be disposed at a distance from the stopper 23. By disposing them at a distance, it is possible to reduce the probability that paper dust generated near the stopper 23 will cover the optical sensor 29.

Figure 3:
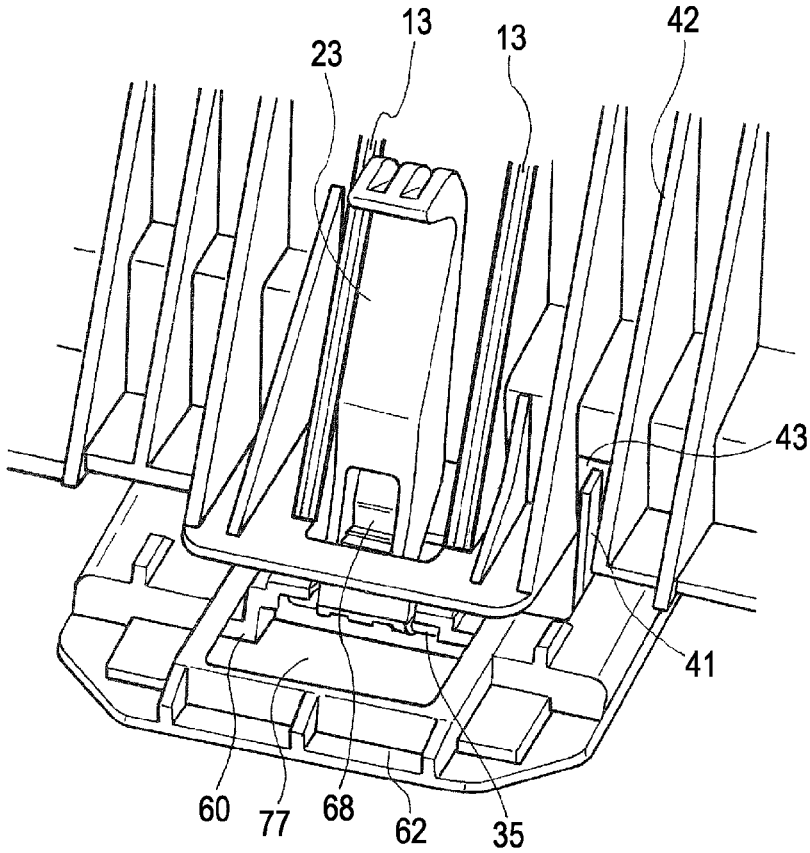
FIG. 3 is a perspective view of the principal parts of the stopper viewed from in front in the first direction of the supply device according to the first embodiment, with the stopper in the regulating position.
Figure 4:
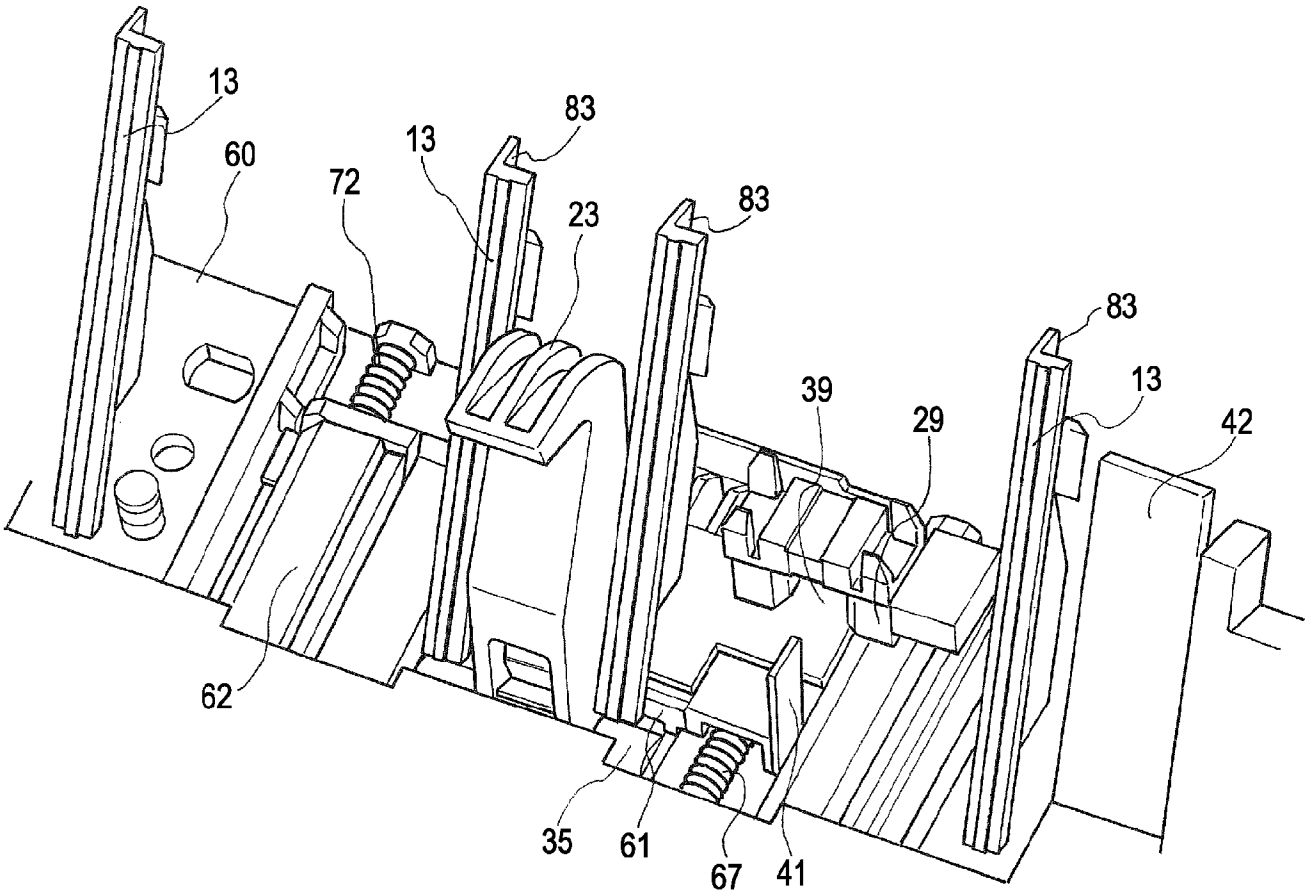
FIG. 4 is a perspective view of the principal parts showing the attitude of FIG. 3 but excluding some constituent members of the movement path.
Figure 5:
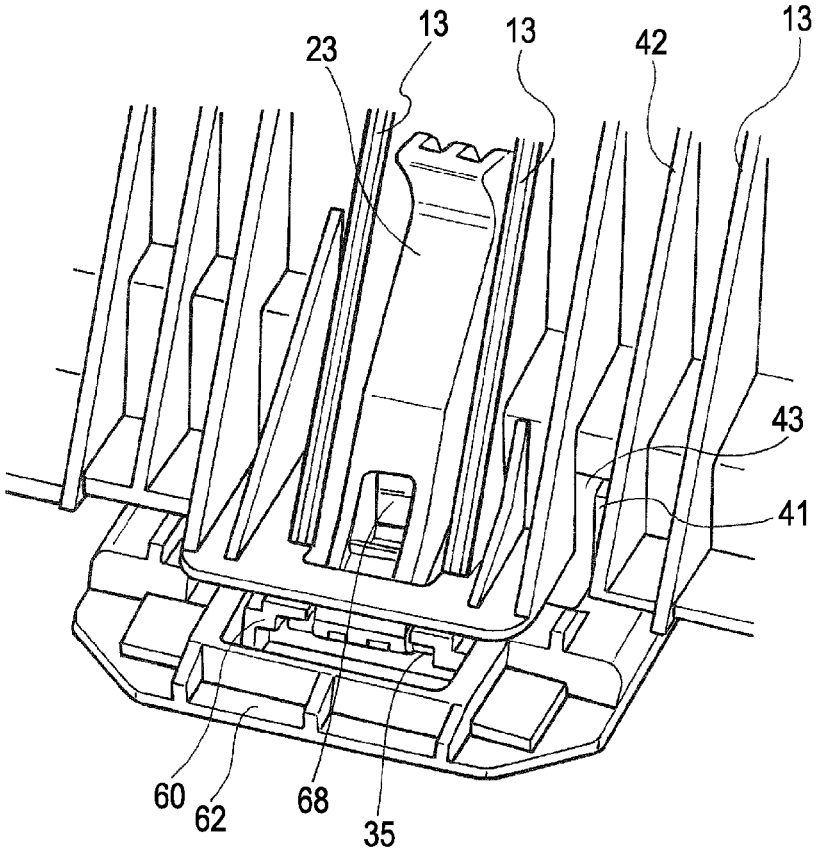
FIG. 5 is a perspective view of the principal part of the stopper viewed from the front in the first direction of the supply device according to the first embodiment, with the stopper in the retracted position.

In addition, as shown in FIGS. 3 and 5, the aperture for emitting the light is disposed to the rear side of a member 42 that constitutes the movement path of the sheets P. A slit 43 is formed in the member 42 that constitutes the movement path, and the screen 41 passes the slit 43 to arrive at the light path of the sensor 29. In this way, it is possible to further reduce the probability that paper dust generated by the stopper 23 will cover the optical sensor 29.

Control Unit (FIG. 1)

As shown in FIG. 1, the supply device 31 according to this embodiment includes a control unit 44 that controls the supply operation by the sheet supply roller 10 to start when the sensor 29 is ON.

A sensor 28 on the upper stage loading section 2 is not shown on the drawings, but likewise the sensor 28 is connected to the control unit 44, which executes control in the same way.

Figure 6:
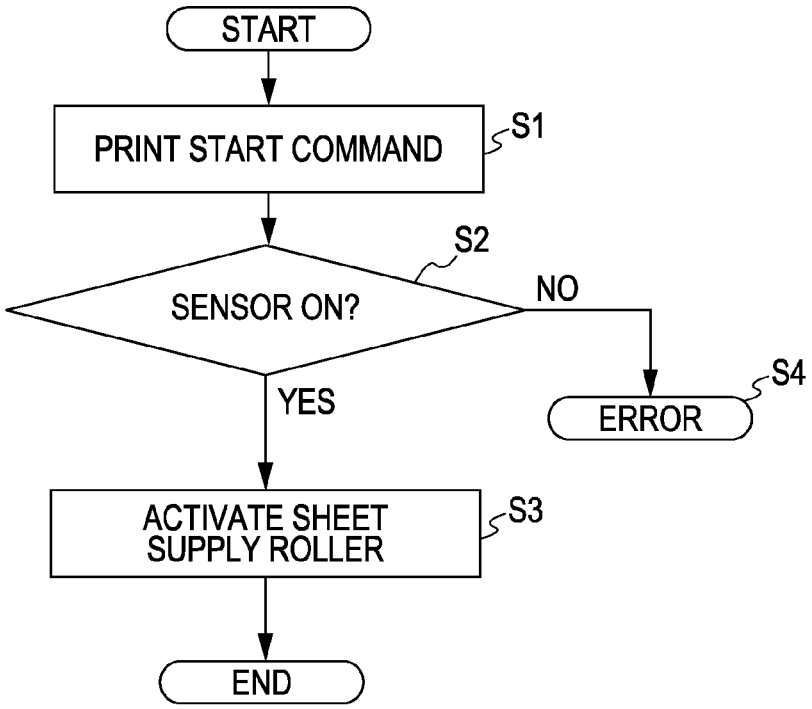
FIG. 6 is a flowchart describing the operation of the first embodiment.

By providing the control unit 44, it is possible to execute the control shown in FIG. 6.

First, in step S1, when the printer 1 receives a command to start printing, printing is not started immediately, but in step S2 the control unit 44 determines whether or not it has detected that the sensor 29 is ON.

If it is detected that the sensor 29 is ON, it means that the stopper 23 has moved from the regulating position to the retracted position under the braking force of the damper mechanism 27. Therefore, the printer 1 is in the state that a sheet P can be transported by the sheet supply roller 10, so in step S3 the sheet supply roller 10 is activated, a sheet P is fed towards the recording execution area 11, and printing by the recording head 19 starts.

In step S2, if it is not detected that the sensor 29 is ON after a predetermined period of time has passed, in step S4 it is determined that an error has occurred, and the user is informed.

In this embodiment, the predetermined time setting can be adjusted. In the case of the damper mechanism 27 that obtains braking force by using grease as in this embodiment, the viscosity varies depending on ambient temperature, so the braking force also varies greatly. As a result, the time required for the stopper 23 to move from the regulating position to the retracted position varies, so the predetermined time can be varied and adjusted to take this into consideration.

As described above, according to the supply device of this embodiment and the recording apparatus that includes this supply device, the stoppers 22, 23 are constituted so that they start to move from the regulating position to the retracted position as a result of the operation of loading the cassettes 4, 5 in the loading sections 2, 3, in other words the setting operation of housing the sheets P in the housing portions 32, 33. In addition, the stoppers 22, 23 start to move gently under the effect of the braking force of the damper mechanisms 26, 27, and continue to move gently to the retracted position. By starting this gentle movement, the movement of the sheets P in a first direction (arrow symbol 8, 9) based on the setting operation of inserting the cassettes 4, 5 or the like is stopped by the stoppers 22, 23, so it is possible to reduce the occurrence of the climbing up problem.

Thereafter, the stoppers 22, 23 continue to move gently and arrive at the retracted position, but arrival at the retracted position is detected by the sensors 28, 29. Therefore, it is possible to ensure that before the stoppers 22, 23 arrive at the retracted position, transport of the sheet P is not started by the sheet supply roller 10.

Also, if the braking force of the damper mechanisms 26, 27 varies due to variations in the environment such as temperature or the like, the time required to arrive at the retracted position will vary. However, according to this embodiment the sensors 28, 29 detect the arrival at the retracted position without being affected by these variations, so it is possible to start the subsequent operation at the appropriate timing. If this embodiment is used in an environment that is not affected by temperature or the like, the "time required" referred to above becomes the appropriate time, so the effect that it is possible to prevent a reduction in throughput can be obtained.

Also, according to this embodiment, when it is detected that the sensors 28, 29 are ON, it is confirmed that the cassettes 4, 5 have been loaded in the loading sections 2, 3. Therefore, control can be executed based on the result of determining whether or not the cassette is loaded. For example, when the user forgets to load the cassette, it is possible to execute a control to inform the user.

Other Embodiments

The recording apparatus 1 according to the invention has the basic constitution as described above, but of course the constitution can be partially changed or omitted and so on, without deviating from the intent of the claimed invention.

Figure 13:
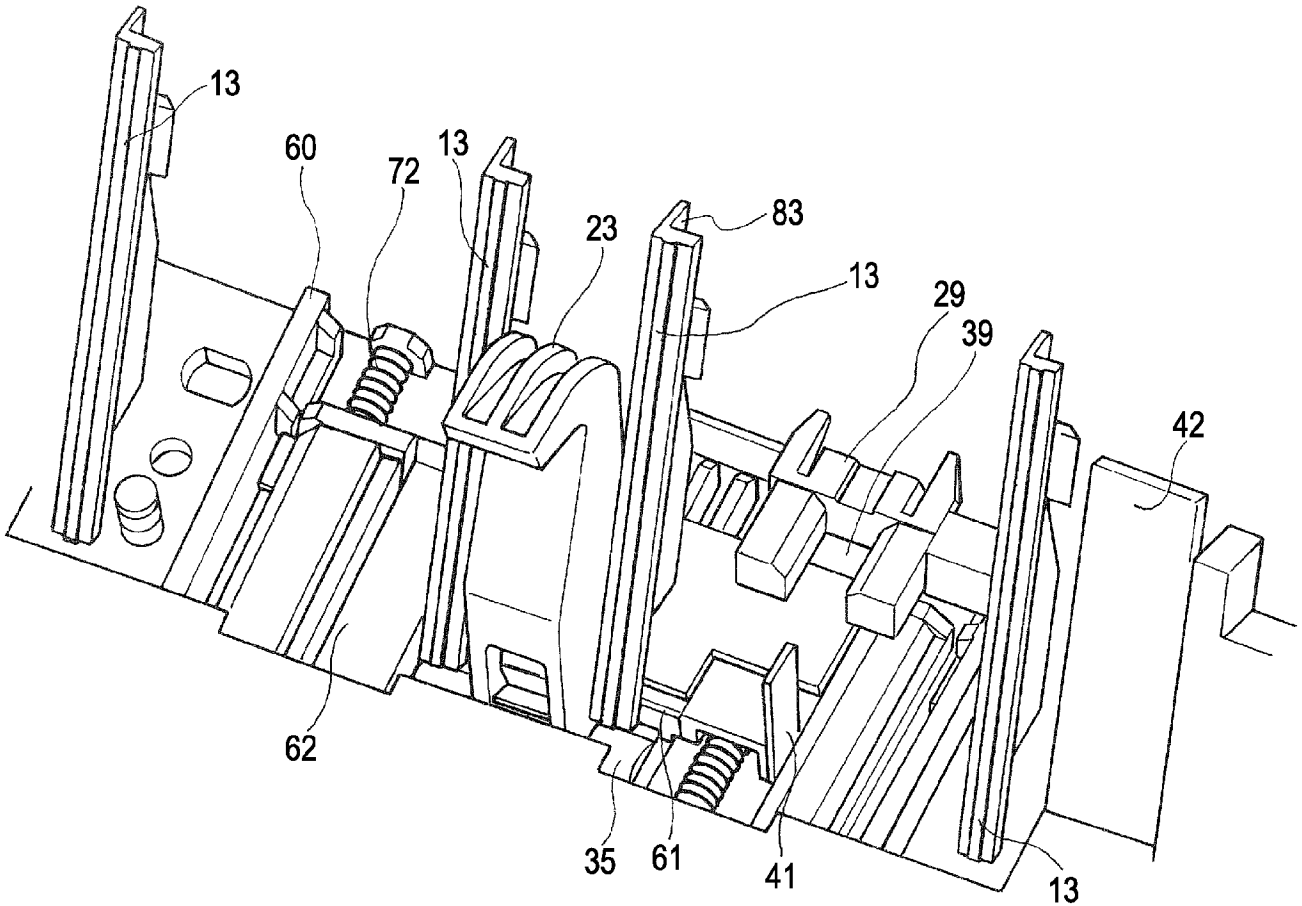
FIG. 13 is a perspective view of the principal parts showing the attitude of FIG. 3 but excluding some constituent members of the movement path, and with a different sensor installation position.

FIG. 13 shows a structure in which the sensors 28, 29 have been installed oriented so that the light path 39 travels in the direction that the screen approaches. This embodiment differs from the previous embodiment in that the light path 39 is not to the rear of the member 42 that constitutes the movement path, but is located to the front side. The same effect as the previous embodiment can be obtained with this embodiment.

The entire disclosure of Japanese Patent Application No. 2011-42332, filed Feb. 28, 2011 is expressly incorporated by reference herein.

What is claimed is:

1. A recording apparatus, comprising:

a recording head that records onto recording material;

a cassette that houses the recording material;

a loading section for loading the cassette;

a guide surface that guides the recording material fed from the cassette that is loaded in the loading section;

a supply mechanism that feeds the recording material housed in the cassette that is loaded in the loading section;

a stopper that regulates movement of the recording material moving onto the guide surface when the cassette is loaded in the loading section, and that is moved from a regulating position located in front of the guide surface to a retracted position located behind the guide surface; and a sensor that detects that the stopper has moved into a retracted position.

2. The recording apparatus according to claim 1, further comprising a control unit that controls the feeding operation by the supply mechanism after the sensor has detected that the stopper has moved into the retracted position.

3. The recording apparatus according to claim 2, further comprising a screen that is coupled to movement of the stopper, wherein the sensor is an optical sensor that detects the screen blocking a light path.

4. The recording apparatus according to claim 3, wherein the screen is located in a position separated from the stopper.

5. The recording apparatus according to claim 4, further comprising a damper mechanism that applies a braking force to the movement of the stopper into the retracted position.

6. The recording apparatus according to claim 5, wherein the stopper includes a slider having a sliding surface that constitutes the damper mechanism, and the screen is provided on the slider.

* * * * *